United States Patent [19]

Hruda

[11] 3,950,670

[45] Apr. 13, 1976

[54] ELECTRODELESS DISCHARGE ADAPTOR SYSTEM

[75] Inventor: Robert M. Hruda, Horseheads, N.Y.

[73] Assignee: Westinghouse Electric Corporation, Pittsburgh, Pa.

[22] Filed: Oct. 29, 1974

[21] Appl. No.: 518,912

[52] U.S. Cl. ..... 315/344; 356/85

[51] Int. Cl.[2] ..... H05B 41/00

[58] Field of Search ..... 356/87, 85; 315/150, 248, 315/267, 344, 348

[56] References Cited

UNITED STATES PATENTS

| | | | |
|---|---|---|---|
| 3,248,548 | 4/1966 | Booth et al. | 315/248 X |
| 3,439,290 | 4/1969 | Shinoda | 331/56 X |
| 3,645,629 | 2/1972 | Dagnall | 356/87 X |

*Primary Examiner*—James B. Mullins
*Attorney, Agent, or Firm*—W. G. Sutcliff

[57] ABSTRACT

An electrodeless discharge lamp system which is adaptable to an atomic absorption spectroscopy unit which is designed for hollow cathode discharge device operation.

3 Claims, 3 Drawing Figures

ELECTRODELESS DISCHARGE ADAPTOR SYSTEM

BACKGROUND OF THE INVENTION

The present invention relates to atomic absorption spectroscopy equipment generally, and more particularly to an electrodeless discharge light source system which is useable and adaptable with an atomic absorption unit designed for a hollow cathode discharge light source.

Atomic absorption spectroscopy is a valuable analytic tool which is used in qualitative and quantitative analysis of chemical constituents in a variety of applications. The uses range from medical technology to pollution control technology. An atomic absorption unit is basically a spectrograph coupled to the sample vapor cell, with a high intensity light source directing light through the sample cell, so that the sample absorbs the light of the characteristic wavelength. The intensity and uniformity of light from the light source are particularly important in defining the accuracy of the system. The most widely utilized light source for such an atomic absorption unit is a hollow cathode discharge light source, such as described in U.S. Pat. No. 3,264,511. The hollow cathode discharge device permits highly directional light emission with good stability. The emitted radiation is contained within a few narrow, well defined wavelengths characteristic of the material used in the cathode. The hollow cathode design has been found utilizable with a broad spectrum of elements, and has successfully permitted extension of the analytic technique to a broad range of industrial applications.

It is the general practice for such atomic absorption units to operate in a pulsed mode with the light source being switched on and off in synchronism with the internal functioning of the spectrograph. A normally used hollow cathode discharge device is switched on and off by electronic gating of the device current. The hollow cathode discharge device must also be accurately aligned with the spectrograph.

A recently developed light source for use in such atomic absorption units is an electrodeless discharge lamp. The electrodeless discharge lamp is merely a light transmissive envelope containing a radiation emissive vapor which is excited by radio frequency energy. Such electrodeless discharge lamps have been found advantageous for certain types of elements. A standard atomic absorption unit already in the field should therefore be desirably adaptable to permit usage with the newly developed electrodeless discharge light sources, as well as with the conventionally used hollow cathode discharge devices. Such adaptability must preserve the precise optical coupling of the light source with the spectrograph, and permit ready changeability, since the end user will desire to use one or the other type of light source depending on the element being analyzed. The standard power supply for an atomic absorption unit for use with hollow cathode discharge device where pulsed operation is typically a relatively high voltage short duration pulse typically about 600 volts. The electrodeless discharge devices are typically operated at frequencies ranging to several hundred megahertz with pulse repetition rates of 30 to 1000 hertz.

SUMMARY OF THE INVENTION

An electrodeless discharge device system which is readily adaptable to an atomic absorption spectrometer. The spectrometer unit provides a low frequency pulsed light source power signal which is synchronized with the atomic absorption optical sensing mechanism of the spectrometer. The system comprises an electrodeless discharge light source coupled to and driven by a radio frequency tuned coil, radio frequency input means, electrical connection means between the elctrodeless discharge device system and the atomic absorption spectrometer power supply. The pulsed light source power signal is communicated to the radio frequency tuned coil. Control means are provided for adapting the pulse light source power signal to control and synchronously apply the radio frequency power signal to the tuned coil. The control means is preferably disposed within a unitary electrodeless discharge system.

DESCRIPTION OF THE PREFERRED EMBODIMENTS

Figure 1:
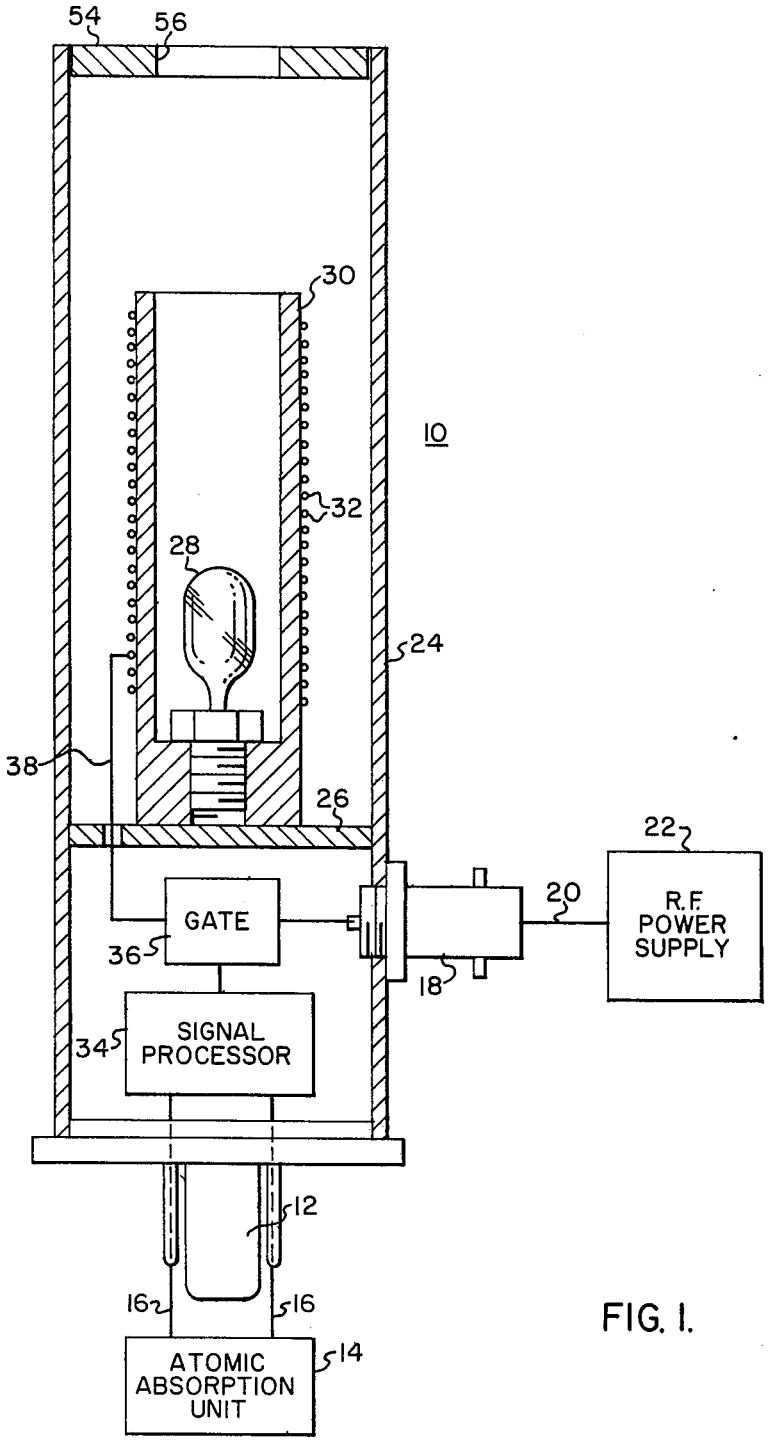
FIG. 1 is a side elevational view partly in section of an electrodeless device system of the present invention.

The present invention can be best understood by reference to the exemplary embodiment seen in Figures of the drawings. The electrodeless discharge device system 10 seen in FIG. 1 comprises the system 10, coupled by a hollow cathode base 12 to the atomic absorption unit 14 by the electrical lead-ins 16. The electrodeless discharge system is also coupled by radio frequency connector 18 and electrical lead line 20 to the radio frequency power supply 22. A generally cylindrical enclosure member 24 is mounted on the hollow cathode base 12, and is typically a copper or aluminum tubular body several inches in diameter. A disc-like support platform 26 divides the interior of the cylindrical enclosure member 24 into two chambers, with the upper chamber including electrodeless discharge device 28 which is mounted within a generally tubular support body 30 about which is disposed a tuned radio frequency coil 32. The electronic adaption package is integrally enclosed and contained with the enclosure member 24 below the support member 26. A signal processor unit 34 is electrically connected to the atomic absorption power supply via leads 16, and hollow cathode base lead-ins in the low frequency relatively high voltage pulses provided by the atomic absorption power supply. These voltage pulses are applied to the signal processor which in turn is connected to a gate means 36 which is used to gate a radio frequency signal applied from power supply unit 22 from a lead 20, radio frequency connector 18 and the lead 38 which is directly connected to the tuned radio frequency coil 32. A wide variety of signal processor means 34 and gate means 36 can be utilized in practicing the present invention. By way of example, signal processor unit 34 can comprise a transformer means, the input side of which is connected to the hollow cathode base socket and receives an atomic absorption radio frequency pulse current which is transformed to provide on the output side of the transformer a low impedance signal which is passed through a frequency isolating coil serially connected to the gate means which is a drive transistor with one of the transformer output leads being connected to the base of the transistor, and the other being connected to the emitter of the transistor and to the RF ground. The collector of the transistor is connected to the radio frequency input lead line which is then connected to the radio frequency tuned coil. The transformer should preferably effect 180° phase shift in the atomic absorption unit signal, so that the electrodeless discharge light source can be actuated and be light emissive when the atomic absorption unit current is on. The processor unit works in that the transformed signal drives the transistor to shunt the RF signal to ground to effectively switch the radio frequency signal and synchronize it with the atomic absorption unit. The RF power supply is typically operated at several hundred megahertz frequency. In another embodiment the signal processor unit can consist of an isolation circuit which utilizes a resistor to step down the low frequency relatively high voltage atomic absorption unit square wave pulse to a relatively low voltage signal, which is used to drive the serially connected light emitting diode which is optically coupled to a phototransistor which is used as gate means for the radio frequency power signal. In this way the high voltage output signal of the atomic absorption unit may be effectively isolated from the entire system.

Figure 3:
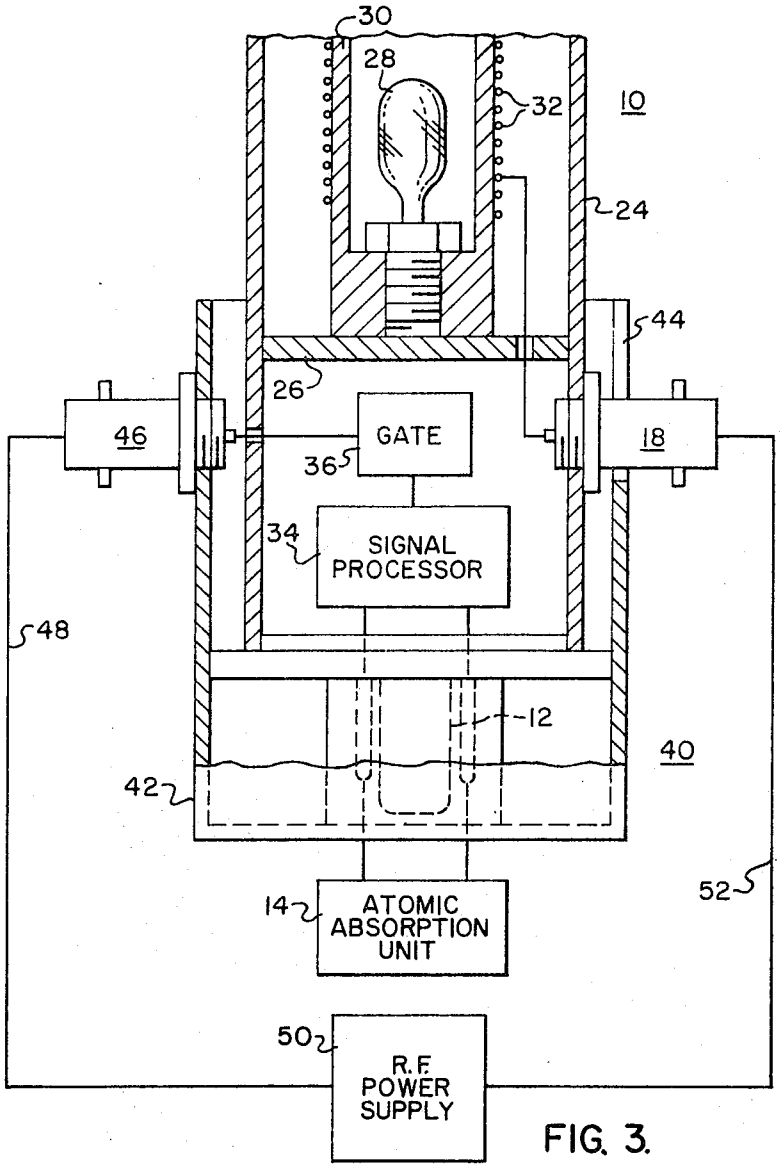
FIG. 3 is yet another alternative embodiment of the present invention.
Figure 2:
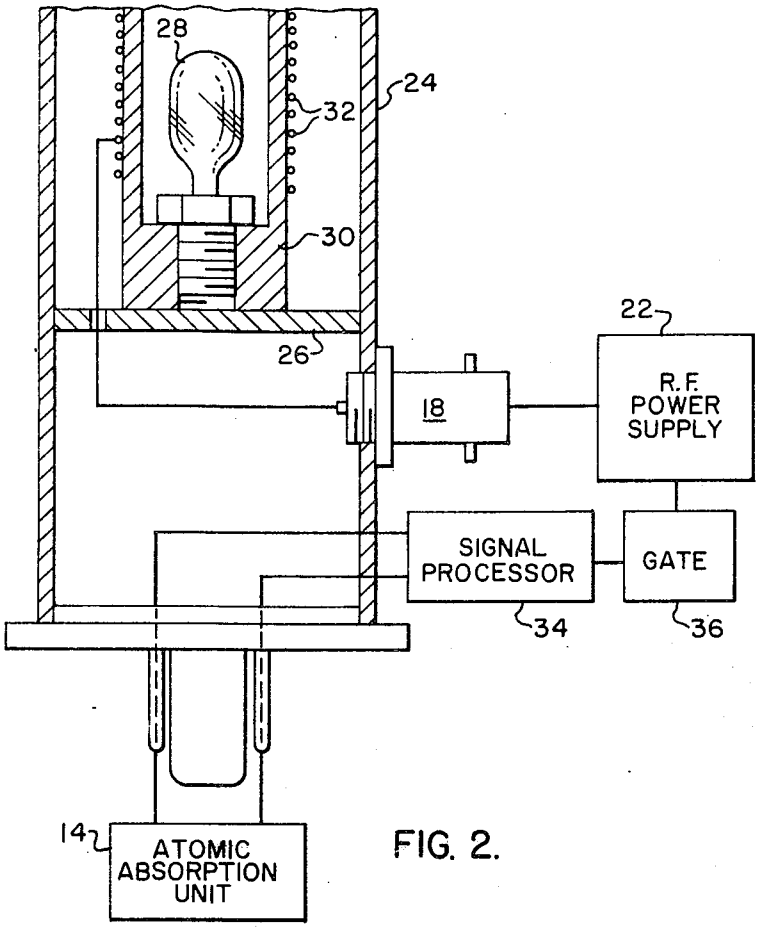
FIG. 2 is an alternative embodiment of the present invention.

An alternative embodiment is seen in FIG. 2 wherein the signal processor 34 and gate means 36 are disposed external to the electrodeless discharge lamp enclosure member 24 and are typically associated with the radio frequency power supply itself. This merely necessitates passing the atomic absorption unit signal into the unit through the hollow cathode type base means and providing outlet leads from enclosure member 24 for carrying the signal to the signal processor 34 and gate means 36, which are then connected to the radio frequency power supply 22 to apply the radio frequency power to the tuned RF coil 32. In the embodiment seen in FIG. 3 a highly accurate optical alignment unit 40 is adapted to the electrodeless discharge lamp system of FIG. 1. This insures accurate optical alignment of the system with a specific type of atomic absorption spectrometer unit. The alignment unit 40 is a generally cup-shaped member 42 having an electrical base unit at the bottom thereof. A slot 44 is provided in the side wall to permit clearance of the RF connector 18 via which the RF signal is fed to the coil. In this embodiment, the signal from the spectrometer is fed via the base to the signal processor and gate means which are disposed at the base of the enclosure member 24 of unit 10. The gate output is transmitted via output connector 46 and lead line 48 to the RF power supply 50. The RF power signal is transmitted via lead line 52 to the input RF connector 18 and to the coil.

The enclosure member 24 is a conductive metal cylinder which is open at one end to permit passage of the generated light output. It is desirable to minimize leakage of RF energy from the enclosure while still permitting passage of light. It is also desirable to be able to variably tune the RF coil to permit optimum operation of the light source 28. A conductive metal disc member 54 as shown in the FIG. 1 embodiment, is slidably fitting within the open end of the cylindrical enclosure member 24. A central aperture 56 is provided through the disc member 54 aligned with the longitudinal axis of the enclosure member 24 so that light may be passed. The central aperture is typically about 0.5 inch in diameter, while the disc member itself is about 1.5 inch in diameter. The sliding fit between the disc member 54 and the interior surface of the enclosure member provides electrical contact therebetween. The conductive disc member is capacitively coupled to the RF coil 32 by its proximity thereto. Movement of the disc member along the cylinder axis has been found to effectively tune the RF coil for operation at the desired high frequency at which optimum light output is produced in the electrodeless discharge light source 28. In this way the light source 28 and coil 32 remain in position providing a set optical system.

I claim:

1. An electrodeless discharge device system comprising:

a hollow cylindrical enclosure conductive member having a light transmissive aperture at one end with a resonance cavity defining conductive support closing off the cylindrical enclosure conductive member intermediate opposed ends of the cylinder;

an RF tuned coil disposed within the resonant cavity defined by the cylindrical enclosure conductive member and the conductive support;

an electrodeless discharge light source within the enclosure conductive member and coupled to the RF tuned coil to absorb RF energy radiated from the coil and produce light which is directed through the light transmissive aperture;

electrical plug-in means disposed at the end of the enclosure member opposite from the apertured light output end, for electrically connecting said system to a low frequency pulse light source power signal means;

an RF input connector disposed in an aperture in the enclosure member;

signal processing means, within the space defined by the enclosure member and the electrical plug-in means, connected to the low frequency pulsed light source power signal via the plug-in means and connected to the RF input connector, which signal processing means controls application of a pulsed RF power signal to the tuned coil in synchronism with the low frequency pulse of light source power signal.

2. An electrodeless discharge device system as specified in claim 1, wherein an apertured conductive disc slidably fits within the cylindrical enclosure member at the apertured end, to permit tuning of the resonant cavity and the RF coil for optimum operation of the electrodeless discharge light source.

3. An electrodeless discharge device system comprising:

a hollow generally cylindrical conductive member which is open at one end thereof;

a generally tubular support mounted concentrically within said cylindrical conductive member;

an elongated RF tunable coil disposed about the tubular support member;

an electrodeless discharge light source disposed proximate one end of the tunable coil along the coil axis;

and a disc-like conductive member having a central aperture therethrough slidably fitting within the open end of the cylindrical conductive member, which disc-like conductive member is slidable within said cylindrical conductive member along the cylinder axis, and is capacitively coupled to the RF coil, so that the RF coil is tuned to a selected frequency as the disc-like conductive member is moved along the cylinder axis.

* * * * *